US011758628B2

(12) United States Patent
Peng

(10) Patent No.: US 11,758,628 B2
(45) Date of Patent: Sep. 12, 2023

(54) LIGHT EMITTING DIODE LAMP

(71) Applicant: Semisilicon Technology Corp., New Taipei (TW)

(72) Inventor: Wen-Chi Peng, New Taipei (TW)

(73) Assignee: SEMISILICON TECHNOLOGY CORP., New Taipei (TW)

( * ) Notice: Subject to any disclaimer, the term of this patent is extended or adjusted under 35 U.S.C. 154(b) by 214 days.

(21) Appl. No.: 17/146,406

(22) Filed: Jan. 11, 2021

(65) Prior Publication Data

US 2021/0136892 A1 May 6, 2021

Related U.S. Application Data

(63) Continuation-in-part of application No. 16/126,535, filed on Sep. 10, 2018, now Pat. No. 10,932,348.

(51) Int. Cl.
*H05B 45/30* (2020.01)
*H05B 47/19* (2020.01)

(52) U.S. Cl.
CPC ..... *H05B 45/30* (2020.01); *H05B 47/19* (2020.01)

(58) Field of Classification Search
CPC ..... H05B 47/19; H05B 45/00; H05B 45/37; H05B 45/52–54
See application file for complete search history.

(56) References Cited

U.S. PATENT DOCUMENTS

2008/0041930 A1* 2/2008 Smith ..... G06F 9/44505 340/572.1
2010/0213876 A1* 8/2010 Adamson ..... A47F 11/10 315/312
2016/0119277 A1* 4/2016 Peng ..... H05B 45/30 315/291
2016/0165702 A1* 6/2016 Lai ..... H05B 45/22 315/297
2017/0238397 A1* 8/2017 Green ..... H05B 47/29 315/129

FOREIGN PATENT DOCUMENTS

CN 101222806 A 7/2008
CN 105472830 A 4/2016

OTHER PUBLICATIONS

Office Action dated Mar. 11, 2021 of the corresponding China patent application No. 201810897212.2.

* cited by examiner

*Primary Examiner* — Alexander H Taningco
*Assistant Examiner* — Pedro C Fernandez
(74) *Attorney, Agent, or Firm* — Chun-Ming Shih; HDLS IPR SERVICES

(57) ABSTRACT

A light emitting diode (LED) lamp includes at least one LED and an LED driver. The LED driver includes at least two terminals, a burning processor, and an address memory. The at least two terminals have a power input terminal and a power output terminal. The power input terminal and the power output terminal are externally coupled to a power line. The burning processor receives a burning activation data of a burning signal through the power input terminal or the power output terminal, and directly and externally receives a burning address data of the burning signal without from the power line. When a burning function of the burning processor is activated by the burning activation data, the burning processor converts the burning address data into a local address data and burns the local address data into the address memory.

20 Claims, 14 Drawing Sheets

LIGHT EMITTING DIODE LAMP

CROSS REFERENCE TO RELATED APPLICATION

This application is a Continuation-in-Part of co-pending application Ser. No. 16/126,535, filed on Sep. 10, 2018. The entire contents of which are hereby incorporated by reference.

BACKGROUND OF THE PRESENT DISCLOSURE

Field of the Present Disclosure

The present disclosure relates to a light emitting diode (LED) lamp, and especially relates to a light emitting diode (LED) lamp receiving a burning signal including a burning activation data and a burning address data in different manners.

Description of the Related Art

Currently, there are two types of the related art light emitting diode lamps: the serial-type light emitting diode lamp and the parallel-type light emitting diode lamp. Both the serial-type light emitting diode lamp and the parallel-type light emitting diode lamp need to use a plurality of power transmission lines and signal transmission lines, which waste wires. Afterwards, the related art technology which transmits the lighting signal through the power transmission lines is provided to save the signal transmission lines, wherein the lighting signal comprises the lighting data and the address data.

The local address data has to be burned into the light emitting diode driving apparatus when the light emitting diode driving apparatus is manufactured. The light emitting diode driving apparatus checks whether the address data of the lighting signal is the same with the local address data or not when the light emitting diode driving apparatus receives the lighting signal mentioned above. The light emitting diode driving apparatus drives the light emitting diode to light according to the lighting data of the lighting signal if the address data of the lighting signal is the same with the local address data of the light emitting diode driving apparatus.

However, the disadvantage of the method mentioned above is that once the light emitting diode driving apparatus has been manufactured, the local address data cannot be changed. Therefore, it is very inconvenient for the warehouse management. Moreover, it is also very inconvenient for assembling a lot of the light emitting diode driving apparatuses because the operator has to check the local address data of every light emitting diode driving apparatus carefully to avoid assembling the incorrect light emitting diode driving apparatus.

SUMMARY OF THE PRESENT DISCLOSURE

In order to solve the above-mentioned problems, a first object of the present disclosure is to provide a light emitting diode lamp.

In order to solve the above-mentioned problems, a second object of the present disclosure is to provide a light emitting diode lamp.

In order to achieve the first object of the present disclosure mentioned above, the light emitting diode lamp of the present disclosure includes at least one LED and an LED driver. The LED driver includes at least two terminals, a burning processor, and an address memory. The at least two terminals has a power input terminal and a power output terminal. The power input terminal and the power output terminal are externally coupled to a power line. The burning processor receives a burning activation data of a burning signal through the power input terminal or the power output terminal from the power line, and directly and externally receives a burning address data of the burning signal without from the power line. When a burning function of the burning processor is activated by the burning activation data, the burning processor converts the burning address data into a local address data and burns the local address data into the address memory so that the LED lamp operates in a burning mode. After the local address data are completely burned into the address memory, the LED lamp operates in a lighting mode from the burning mode.

In one embodiment, the burning processor includes a burning signal receiver and a burning address controller. The burning signal receiver receives the burning activation data and the burning address data. The burning address controller is coupled to the burning signal receiver and the address memory. When the burning address controller receives the burning activation data to activate the burning function, the burning address controller receives the burning address data, converts the burning address data into the local address data, and burns the local address data into the address memory.

In one embodiment, the number of the at least two terminals of the LED driver is two; the burning processor receives the burning activation data in a contact manner, and receives the burning address data in a contactless manner.

In one embodiment, the number of the at least two terminals of the LED driver is three; the burning processor receives the burning activation data in a contact manner, and receives the burning address data in a contact manner.

In one embodiment, the LED driver has a third contact; the burning processor directly and externally receives the burning address data through the third terminal.

In one embodiment, the burning address data is a radio-wave data or a light-wave data.

In one embodiment, the burning activation data is a carrier-wave data.

In one embodiment, the LED driver further includes a lighting processor. The lighting processor is externally connected to the power line, and receives a lighting signal with an address data and a lighting data through the power line. When the burning function of the burning processor is activated, the lighting processor is disabled; after the local address data are completely burned into the address memory, the burning processor is disabled and the lighting processor drives the at least one LED to work in the lighting mode according to the lighting signal.

In one embodiment, when the burning signal receiver determines that a voltage of the burning address data is greater than a first predetermined threshold voltage, the burning address controller receives the burning address data.

In one embodiment, when the burning signal receiver determines that a voltage of the burning activation data is greater than a second predetermined threshold voltage, the burning address controller activates the burning function.

In order to achieve the second object of the present disclosure mentioned above, the light emitting diode system of the present disclosure includes at least one LED and an LED driver. The LED driver includes at least two terminals, a burning processor, and an address memory. The at least two terminals has a power input terminal and a power output terminal. The power input terminal and the power output terminal are externally coupled to a power line. The burning processor receives a burning address data of a burning signal through the power input terminal or the power output terminal from the power line, and directly and externally receives a burning activation data of the burning signal without from the power line. When a burning function of the burning processor is activated by the burning activation data, the burning processor converts the burning address data into a local address data and burns the local address data into the address memory so that the LED lamp operates in a burning mode. After the local address data are completely burned into the address memory, the LED lamp operates in a lighting mode from the burning mode.

In one embodiment, the burning processor includes a burning signal receiver and a burning address controller. The burning signal receiver receives the burning activation data and the burning address data. The burning address controller is coupled to the burning signal receiver and the address memory. When the burning address controller receives the burning activation data to activate the burning function, the burning address controller receives the burning address data, converts the burning address data into the local address data, and burns the local address data into the address memory.

In one embodiment, the number of the at least two terminals of the LED driver is two; the burning processor receives the burning address data in a contact manner, and receives the burning activation data in a contactless manner.

In one embodiment, the number of the at least two terminals of the LED driver is three; the burning processor receives the burning address data in a contact manner, and receives the burning activation data in a contact manner.

In one embodiment, the LED driver has a third terminal; the burning processor directly and externally receives the burning activation data through the third contact.

In one embodiment, the burning activation data is a radio-wave data or a light-wave data.

In one embodiment, the burning address data is a carrier-wave data.

In one embodiment, the LED driver further includes a lighting processor. The lighting processor is externally connected to the power line, and receives a lighting signal with an address data and a lighting data through the power line. When the burning function of the burning processor is activated, the lighting processor is disabled; after the local address data are completely burned into the address memory, the burning processor is disabled and the lighting processor drives the at least one LED to work in the lighting mode according to the lighting signal.

In one embodiment, when the burning signal receiver determines that a voltage of the burning address data is greater than a first predetermined threshold voltage, the burning address controller receives the burning address data.

In one embodiment, when the burning signal receiver determines that a voltage of the burning activation data is greater than a second predetermined threshold voltage, the burning address controller activates the burning function.

The advantage of the present disclosure is to increase the reliability and flexibility of the transmission of the burning signal by receiving the burning activation data and the burning address data in different manners.

Please refer to the detailed descriptions and figures of the present disclosure mentioned below for further understanding the technology, method and effect of the present disclosure. The figures are only for references and descriptions, and the present disclosure is not limited by the figures.

DETAILED DESCRIPTION OF THE PRESENT DISCLOSURE

Figure 1:
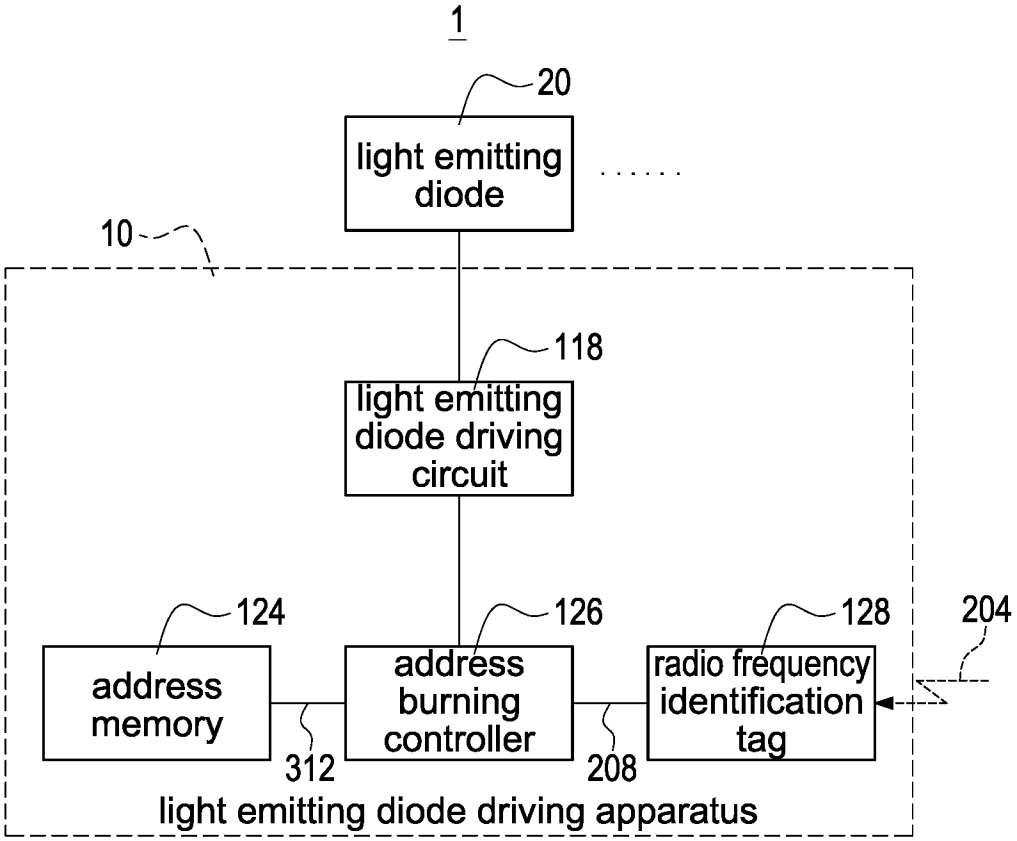
FIG. 1 shows a block diagram of the first embodiment of the light emitting diode lamp utilizing the radio frequency identification signal of the present disclosure.

In the present disclosure, numerous specific details are provided, to provide a thorough understanding of embodiments of the present disclosure. Persons of ordinary skill in the art will recognize, however, that the present disclosure can be practiced without one or more of the specific details. In other instances, well-known details are not shown or described to avoid obscuring aspects of the present disclosure. Please refer to following detailed description and figures for the technical content of the present disclosure:

FIG. 1 shows a block diagram of the first embodiment of the light emitting diode lamp utilizing the radio frequency identification signal of the present disclosure. A light emitting diode lamp 1 of the present disclosure comprises a light emitting diode driving apparatus 10 and at least one light emitting diode 20. The light emitting diode driving apparatus 10 comprises a radio frequency identification tag 128, an address burning controller 126, an address memory 124 and a light emitting diode driving circuit 118. The at least one light emitting diode 20 is electrically connected to the light emitting diode driving apparatus 10. The address burning controller 126 is electrically connected to the radio frequency identification tag 128. The address memory 124 is electrically connected to the address burning controller 126. The light emitting diode driving circuit 118 is electrically connected to the at least one light emitting diode 20 and the address burning controller 126. Moreover, in an embodiment of the present disclosure, the light emitting diode driving apparatus 10 and the at least one light emitting diode 20 are packaged together to become the light emitting diode lamp 1.

The radio frequency identification tag 128 is configured to wirelessly receive a radio frequency identification signal 204. The radio frequency identification tag 128 is configured to convert the radio frequency identification signal 204 into a local address signal 208. The radio frequency identification tag 128 is configured to send the local address signal 208 to the address burning controller 126. The address burning controller 126 is configured to convert the local address signal 208 into a local address data 312. The address burning controller 126 is configured to burn the local address data 312 into the address memory 124 so the address memory 124 is configured to store the local address data 312.

Figure 5:
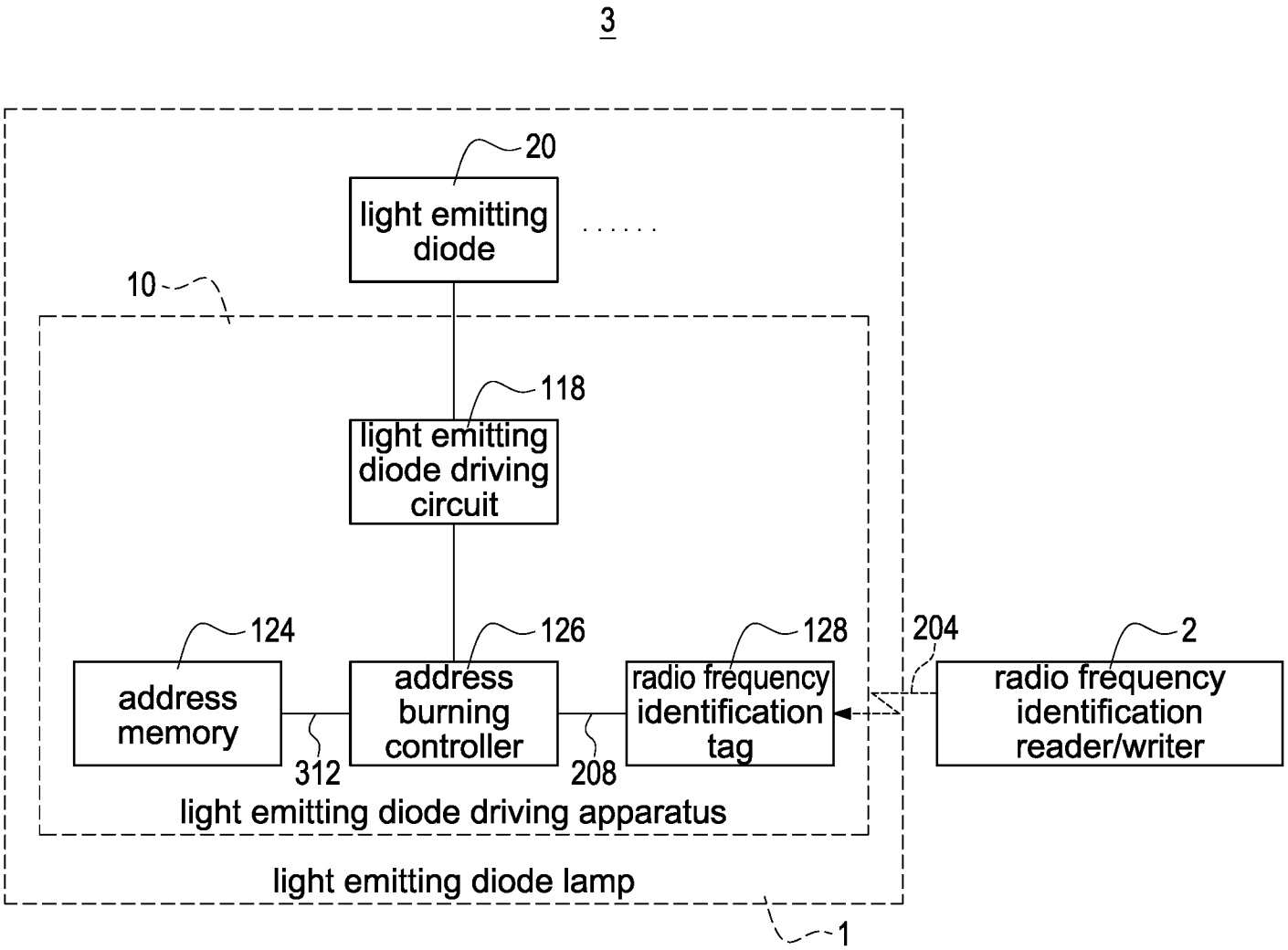
FIG. 5 shows a block diagram of the first embodiment of the light emitting diode system utilizing the radio frequency identification signal of the present disclosure.

In an embodiment of the present disclosure, a radio frequency identification reader/writer 2 shown in FIG. 5 is close to the radio frequency identification tag 128 so the radio frequency identification tag 128 automatically induces the radio frequency identification signal 204. The radio frequency identification reader/writer 2 sets the local address data 312 in the radio frequency identification signal 204 so that the radio frequency identification tag 128 converts the radio frequency identification signal 204 into the local address signal 208, and then the address burning controller 126 converts the local address signal 208 into the local address data 312.

The radio frequency identification tag 128 is a passive radio frequency identification tag. The address memory 124 can be a one-time programmable memory or a multiple-time programmable memory, such as an e-fuse memory, an erasable programmable read only memory (ERPOM), an electrically erasable programmable read only memory (EEPROM) or a flash memory.

Figure 2:
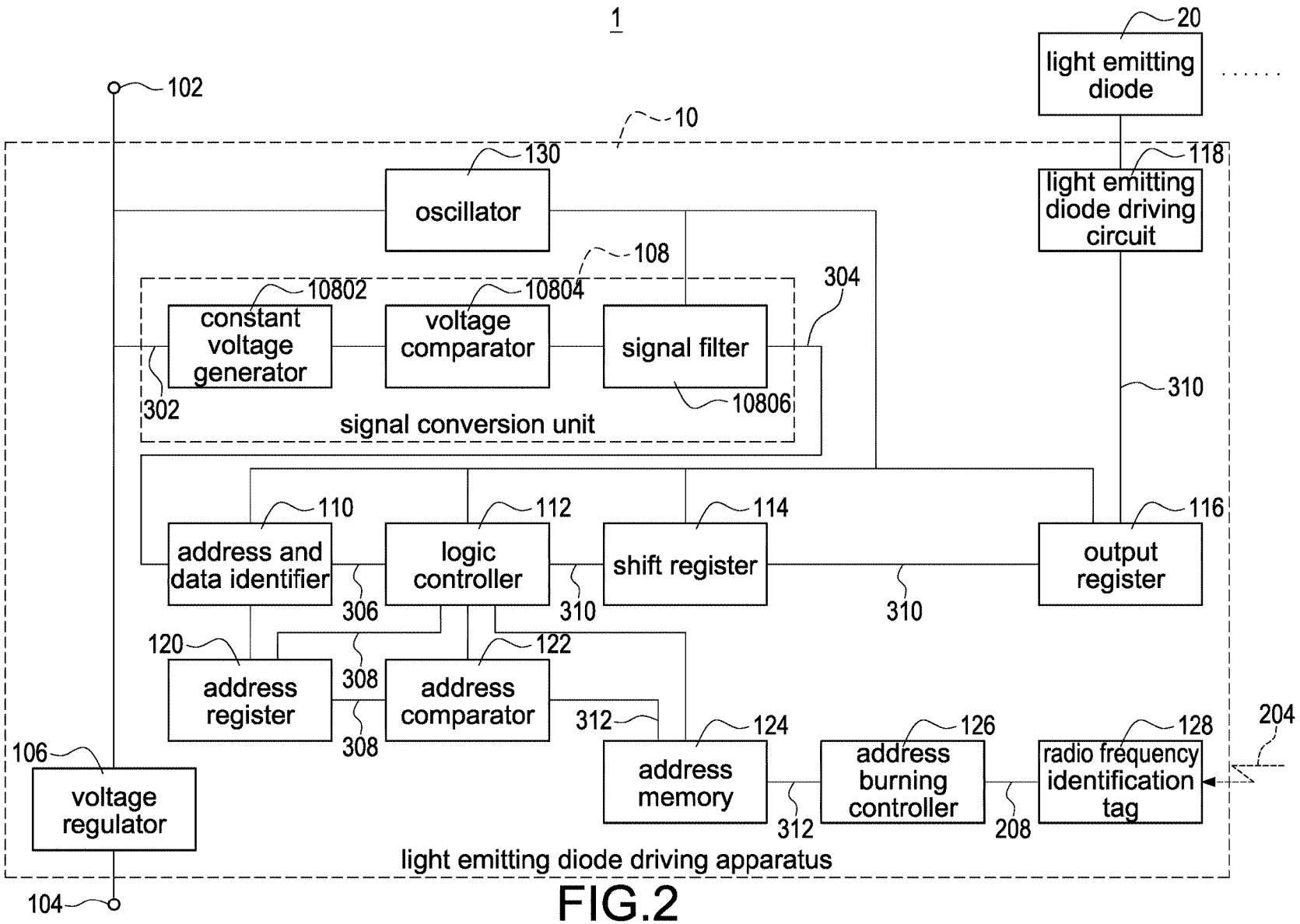
FIG. 2 shows a block diagram of the second embodiment of the light emitting diode lamp utilizing the radio frequency identification signal of the present disclosure.

FIG. 2 shows a block diagram of the second embodiment of the light emitting diode lamp utilizing the radio frequency identification signal of the present disclosure. The descriptions of the elements shown in FIG. 2 which are the same as the elements shown in FIG. 1 are not repeated here for brevity. Moreover, the light emitting diode lamp 1 further comprises a first contact 102 and a second contact 104. The light emitting diode driving apparatus 10 further comprises a signal conversion unit 108, an address and data identifier 110, a logic controller 112, a shift register 114, an output register 116, an address register 120, an address comparator 122, a voltage regulator 106 and an oscillator 130. The signal conversion unit 108 comprises a constant voltage generator 10802, a voltage comparator 10804 and a signal filter 10806. Moreover, the voltage comparator 10804 can be replaced by a voltage subtractor.

The signal conversion unit 108 is electrically connected to the first contact 102. The address and data identifier 110 are electrically connected to the signal conversion unit 108. The logic controller 112 is electrically connected to the address and data identifier 110 and the address memory 124. The shift register 114 is electrically connected to the logic controller 112. The output register 116 is electrically connected to the shift register 114 and the light emitting diode driving circuit 118. The address register 120 is electrically connected to the address and data identifier 110 and the logic controller 112. The address comparator 122 is electrically connected to the logic controller 112, the address register 120 and the address memory 124. The voltage regulator 106 is electrically connected to the first contact 102, the second contact 104 and the signal conversion unit 108. The oscillator 130 is electrically connected to the first contact 102, the voltage regulator 106, the signal conversion unit 108, the address and data identifier 110, the logic controller 112, the shift register 114 and the output register 116. The constant voltage generator 10802 is electrically connected to the first contact 102. The voltage comparator 10804 is electrically connected to the constant voltage generator 10802. The signal filter 10806 is electrically connected to the voltage comparator 10804 and the address and data identifier 110.

The signal conversion unit 108 is configured to receive a first signal 302 through the first contact 102. The signal conversion unit 108 is configured to convert the first signal 302 into a second signal 304 and is configured to send the second signal 304 to the address and data identifier 110. The address and data identifier 110 are configured to identify the second signal 304 to obtain a third signal 306. The third signal 306 comprises an address data 308 and a lighting data 310. The address and data identifier 110 are configured to send the third signal 306 to the logic controller 112. The logic controller 112 is configured to send the address data 308 to the address register 120. The address register 120 is configured to store the address data 308. The address comparator 122 is configured to compare the address data 308 stored in the address register 120 with the local address data 312 stored in the address memory 124. Moreover, the first signal 302 is composed of (namely, comprises) a series of pulse waves.

If the address data 308 stored in the address register 120 is the same with the local address data 312 stored in the address memory 124, the address comparator 122 is configured to inform the logic controller 112 that the address data 308 stored in the address register 120 is the same with the local address data 312 stored in the address memory 124, so that the logic controller 112 is configured to send the lighting data 310 to the light emitting diode driving circuit 118 through the shift register 114 and the output register 116. The light emitting diode driving circuit 118 is configured to drive the at least one light emitting diode 20 to light based on the lighting data 310. Moreover, the first signal 302 is a wired signal. Moreover, FIG. 2 shows that the present disclosure is in a normal state to receive power, and the present disclosure receives the first signal 302 through the first contact 102 to change a lighting mode of the at least one light emitting diode 20 when the present disclosure needs to change the lighting mode of the at least one light emitting diode 20.

Figure 3:
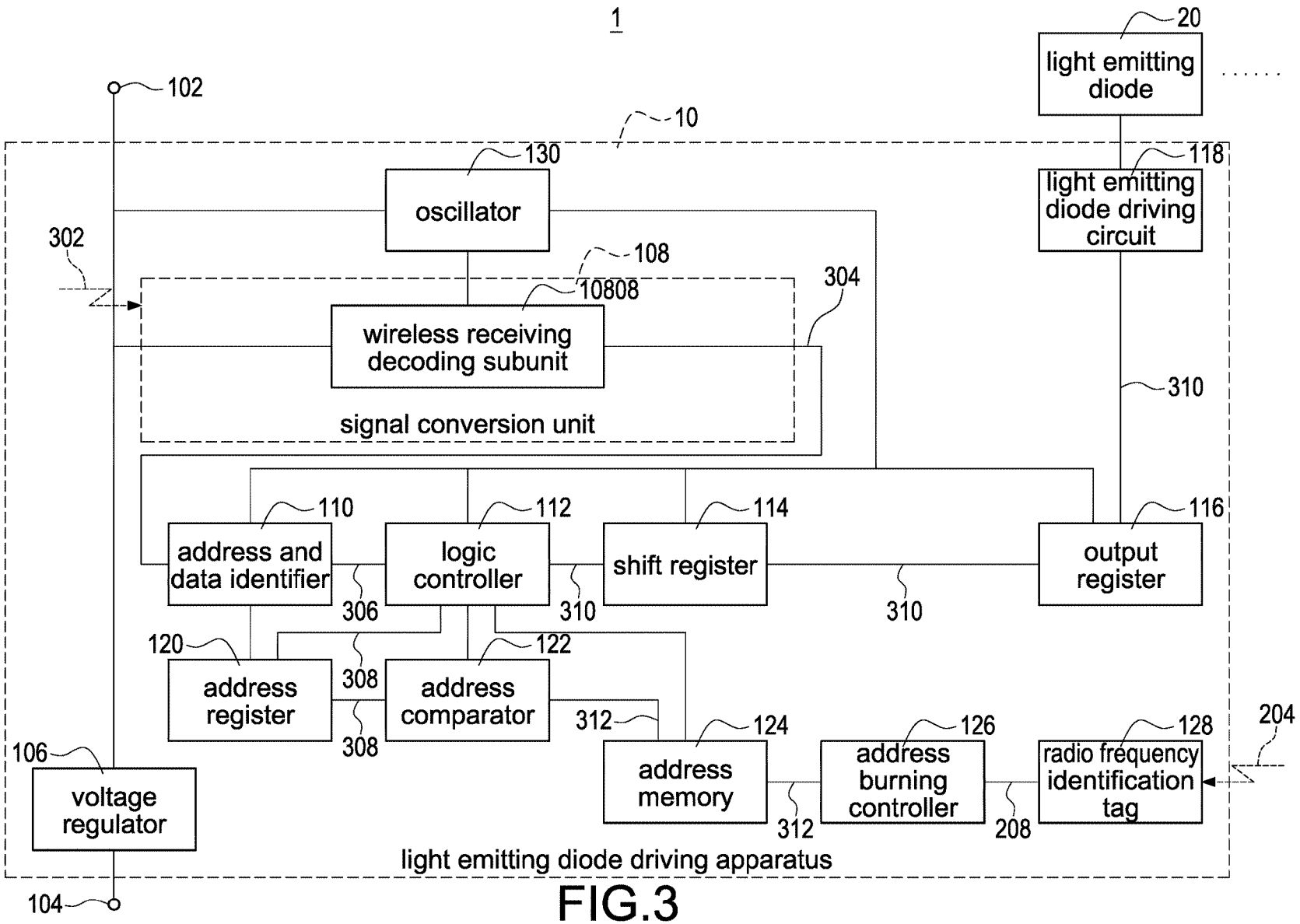
FIG. 3 shows a block diagram of the third embodiment of the light emitting diode lamp utilizing the radio frequency identification signal of the present disclosure.

FIG. 3 shows a block diagram of the third embodiment of the light emitting diode lamp utilizing the radio frequency identification signal of the present disclosure. The descriptions of the elements shown in FIG. 3 which are the same as the elements shown in FIG. 2 are not repeated here for brevity. Moreover, the signal conversion unit 108 comprises a wireless receiving decoding subunit 10808. The wireless receiving decoding subunit 10808 is electrically connected to the first contact 102 and the address and data identifier 110. Moreover, the first signal 302 is a wireless signal. The wireless receiving decoding subunit 10808 is configured to decode the first signal 302 to obtain the second signal 304. Moreover, FIG. 3 shows that the present disclosure is in a wireless receiving state that the light emitting diode driving apparatus 10 through the first contact 102 receives only power. The signal conversion unit 108 does not receive the first signal 302 through the first contact 102, but the signal conversion unit 108 wirelessly receives the first signal 302. The wireless receiving decoding subunit 10808 has functions of both receiving the first signal 302 and decoding the first signal 302, and a wireless module (not shown in FIG. 7) of a control box 5 (shown in FIG. 7) is configured to wirelessly send the first signal 302 to the wireless receiving decoding subunit 10808.

Figure 4:
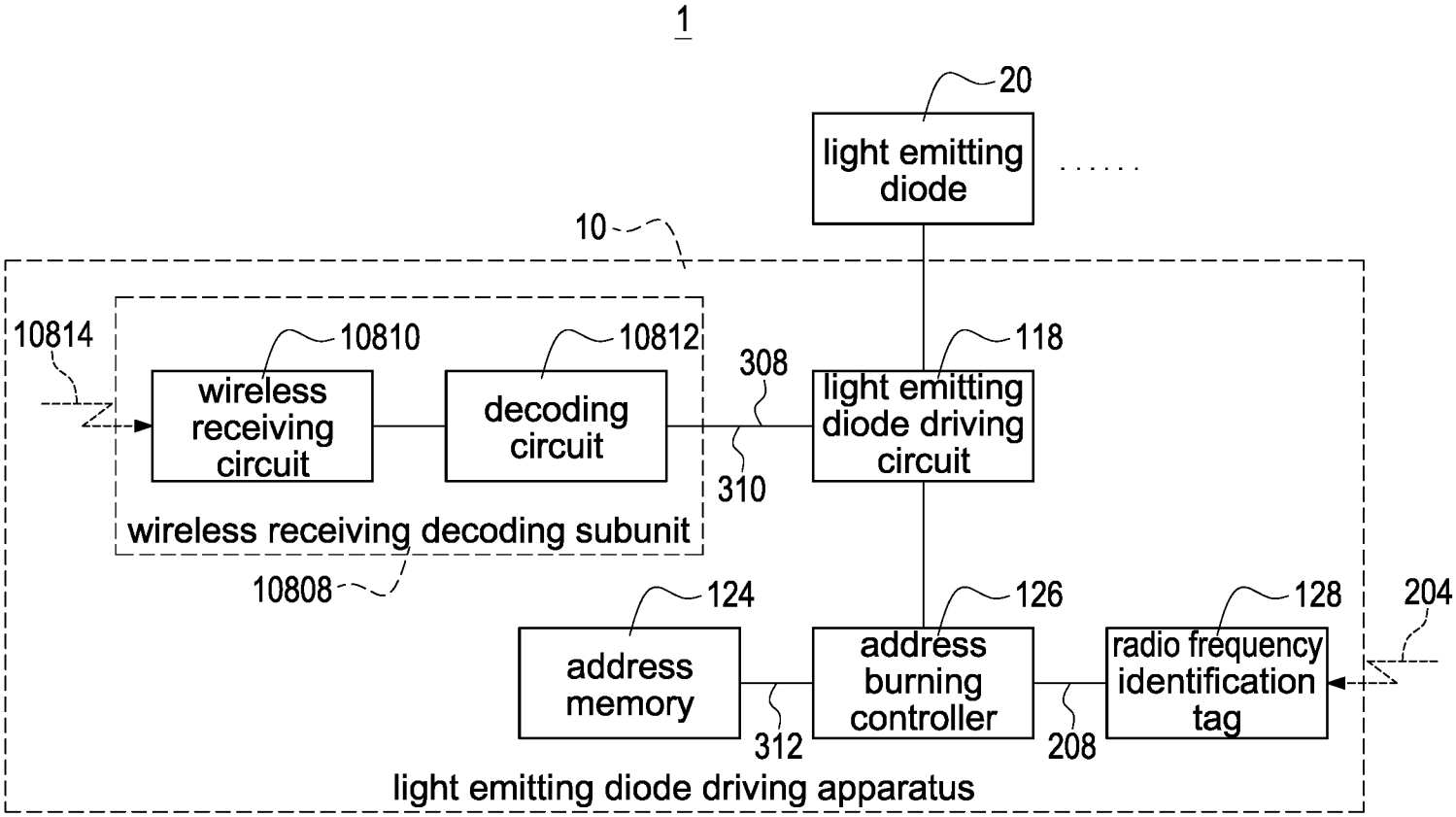
FIG. 4 shows a block diagram of the fourth embodiment of the light emitting diode lamp utilizing the radio frequency identification signal of the present disclosure.

In another embodiment of the present disclosure, please refer to FIG. 4. FIG. 4 shows a block diagram of the fourth embodiment of the light emitting diode lamp utilizing the radio frequency identification signal of the present disclosure. The descriptions of the elements shown in FIG. 4 which are the same as the elements shown in FIG. 1 are not repeated here for brevity. Moreover, the light emitting diode driving apparatus 10 further comprises a wireless receiving decoding subunit 10808. The wireless receiving decoding subunit 10808 comprises a wireless receiving circuit 10810 and a decoding circuit 10812. The wireless receiving decoding subunit 10808 is electrically connected to the light emitting diode driving circuit 118. The decoding circuit 10812 is electrically connected to the light emitting diode driving circuit 118 and the wireless receiving circuit 10810.

The wireless receiving circuit 10810 is configured to wirelessly receive a lighting driving signal 10814, and then the decoding circuit 10812 is configured to decode the lighting driving signal 10814 to obtain an address data 308 and a lighting data 310. The light emitting diode driving circuit 118 is configured to drive the at least one light emitting diode 20 to light based on the lighting data 310 if the address data 308 is the same with the local address data 312 stored in the address memory 124. In FIG. 4, sources of the lighting driving signal 10814 are not limited. The lighting driving signal 10814 is equal to the first signal 302 (namely, wireless signal) if the lighting driving signal 10814 is from the control box 5 (shown in FIG. 7) mentioned above.

FIG. 5 shows a block diagram of the first embodiment of the light emitting diode system utilizing the radio frequency identification signal of the present disclosure. The descriptions of the elements shown in FIG. 5 which are the same as the elements shown in FIG. 1 are not repeated here for brevity. A light emitting diode system 3 of the present disclosure comprises the light emitting diode lamp 1 and a radio frequency identification reader/writer 2. The radio frequency identification reader/writer 2 is wirelessly connected to the light emitting diode lamp 1. Moreover, the radio frequency identification reader/writer 2 is configured to wirelessly send the radio frequency identification signal 204 to the radio frequency identification tag 128.

Figure 7:
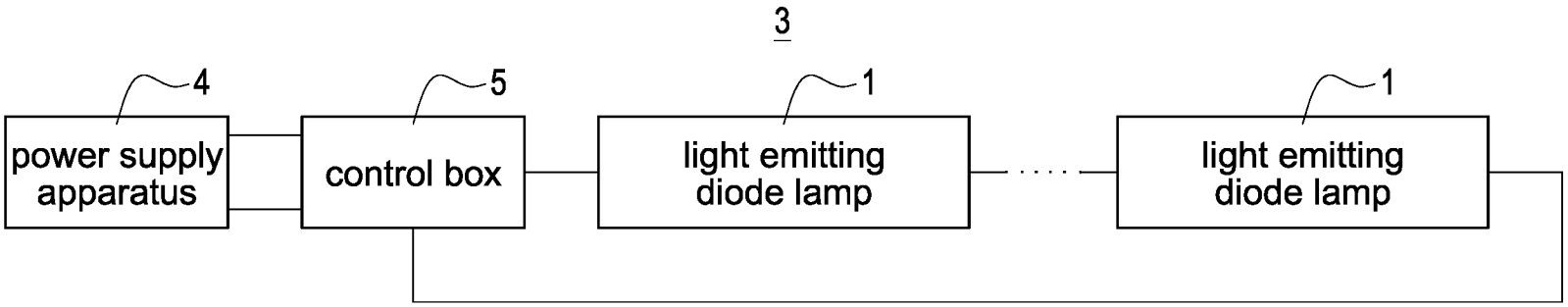
FIG. 7 shows a block diagram of the second embodiment of the light emitting diode system utilizing the radio frequency identification signal of the present disclosure.

FIG. 7 shows a block diagram of the second embodiment of the light emitting diode system utilizing the radio frequency identification signal of the present disclosure. The descriptions of the elements shown in FIG. 7 which are the same as the elements shown in figures mentioned above are not repeated here for brevity. A light emitting diode system 3 of the present disclosure comprises a plurality of the light emitting diode lamps 1, a power supply apparatus 4 and a control box 5. The components mentioned above are electrically connected to each other. The light emitting diode system 3 is a two-wire power carrier lamp string system. The power supply apparatus 4 is, for example but not limited to, an alternating-current-to-direct-current converter.

The light emitting diode lamps 1 are connected to each other in series through the first contacts 102 and the second contacts 104 shown in the figures mentioned above. In FIG. 7, the first contact 102 (not shown in FIG. 7 but shown in the figures mentioned above; namely, the anode) of the first light emitting diode lamp 1 from left to right is connected to the control box 5. The second contact 104 (not shown in FIG. 7 but shown in the figures mentioned above; namely, the cathode) of the last light emitting diode lamp 1 from left to right is connected to the control box 5.

Figure 6:
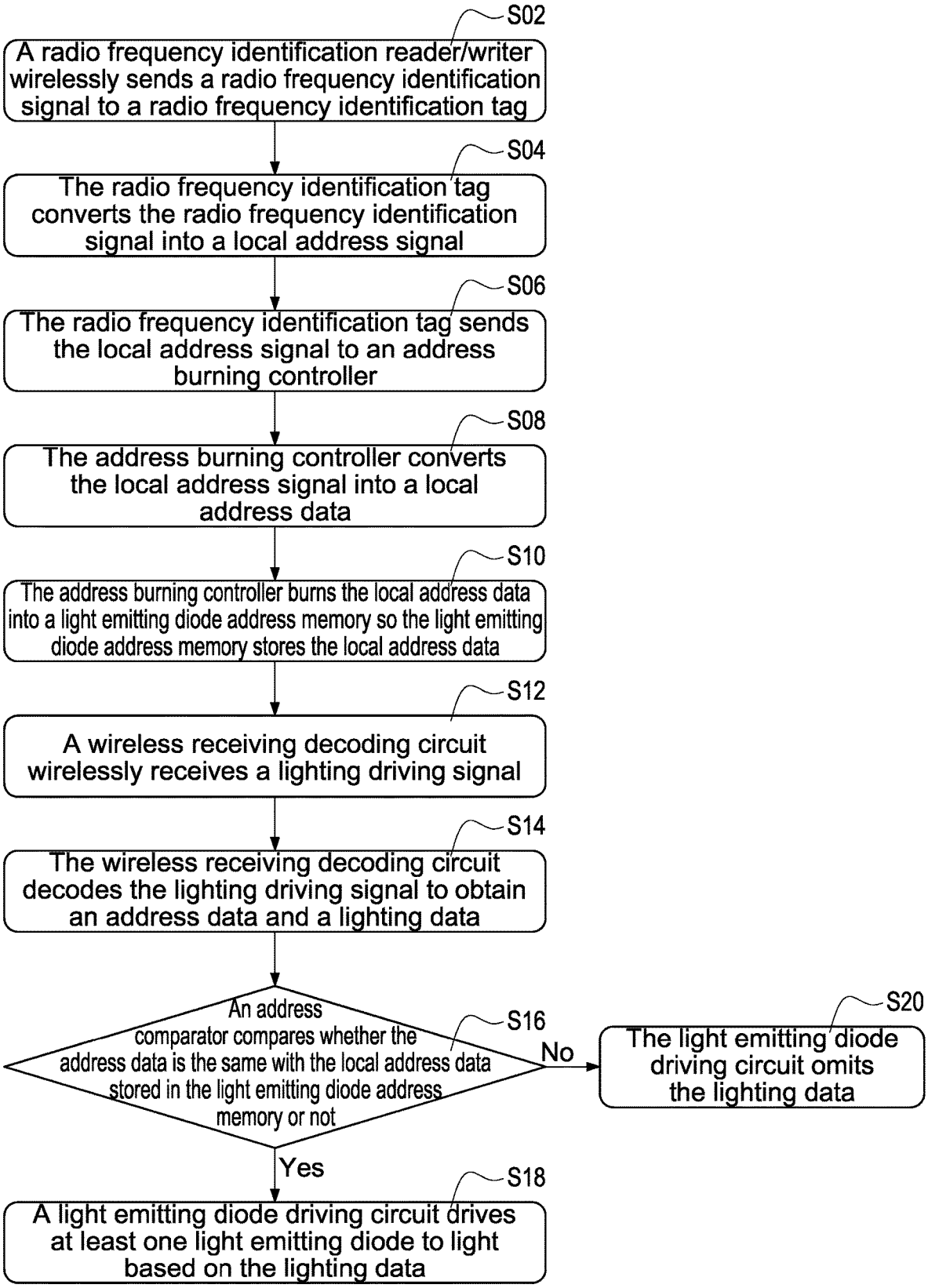
FIG. 6 shows a flow chart of the light emitting diode address burning method utilizing the radio frequency identification signal of the present disclosure.

FIG. 6 shows a flow chart of the light emitting diode address burning method utilizing the radio frequency identification signal of the present disclosure. A light emitting diode address burning method of the present disclosure comprises following steps.

S02: A radio frequency identification reader/writer wirelessly sends a radio frequency identification signal to a radio frequency identification tag. Then the light emitting diode address burning method goes to a step S04.

S04: The radio frequency identification tag converts the radio frequency identification signal into a local address signal. Then the light emitting diode address burning method goes to a step S06.

S06: The radio frequency identification tag sends the local address signal to an address burning controller. Then the light emitting diode address burning method goes to a step S08.

S08: The address burning controller converts the local address signal into a local address data.

Then the light emitting diode address burning method goes to a step S10.

S10: The address burning controller burns the local address data into a light emitting diode address memory so the light emitting diode address memory stores the local address data. Then the light emitting diode address burning method goes to a step S12.

S12: A wireless receiving decoding circuit wirelessly receives a lighting driving signal. Then the light emitting diode address burning method goes to a step S14.

S14: The wireless receiving decoding circuit decodes the lighting driving signal to obtain an address data and a lighting data. Then the light emitting diode address burning method goes to a step S16.

S06: An address comparator compares whether the address data is the same with the local address data stored in the light emitting diode address memory or not. If the address data is the same with the local address data stored in the light emitting diode address memory, the light emitting diode address burning method goes to a step S18. If the address data is not the same with the local address data stored in the light emitting diode address memory, the light emitting diode address burning method goes to a step S20.

S18: A light emitting diode driving circuit drives at least one light emitting diode to light based on the lighting data.

S20: The light emitting diode driving circuit omits the lighting data. Then the light emitting diode address burning method waits another new lighting driving signal.

In an embodiment of the present disclosure, before the step S02, the light emitting diode address burning method further comprises steps that: The radio frequency identification reader/writer sets the local address data in the radio frequency identification signal. The radio frequency identification reader/writer is close to the radio frequency identification tag so the radio frequency identification tag automatically induces the radio frequency identification signal.

In another embodiment of the present disclosure, in the step S12, the wireless receiving decoding circuit comprises a wireless receiving circuit and a decoding circuit. The wireless receiving circuit wirelessly receives the lighting driving signal. In the step S14, the decoding circuit decodes the lighting driving signal to obtain the address data and the lighting data.

The radio frequency identification tag is a passive radio frequency identification tag. The light emitting diode address memory can be a one-time programmable memory or a multiple-time programmable memory, such as an e-fuse memory, an erasable programmable read only memory, an electrically erasable programmable read only memory or a flash memory.

The advantage of the present disclosure is to utilize the radio frequency identification technology to easily burn the local address data 312 into the light emitting diode driving apparatus 10 which had been manufactured to store or change the local address data 312 of the light emitting diode driving apparatus 10. Moreover, the light emitting diode driving apparatus 10 can be burned repeatedly. Moreover, the radio frequency identification tag 128 is the passive radio frequency identification tag, so that the present disclosure can achieve the purpose of saving more power. Moreover, compared to the burning data being sent through the power carriers when burning, the present disclosure can avoid incorrectly determining the conventional carrier signals as the burning signal. Moreover, both the first signal 302 (in FIG. 3) and the lighting driving signal 10814 (in FIG. 4) are the wireless signals, so that the arrangement of the present disclosure can be wider, and is not limited by the lengths of the wires.

Figure 8:
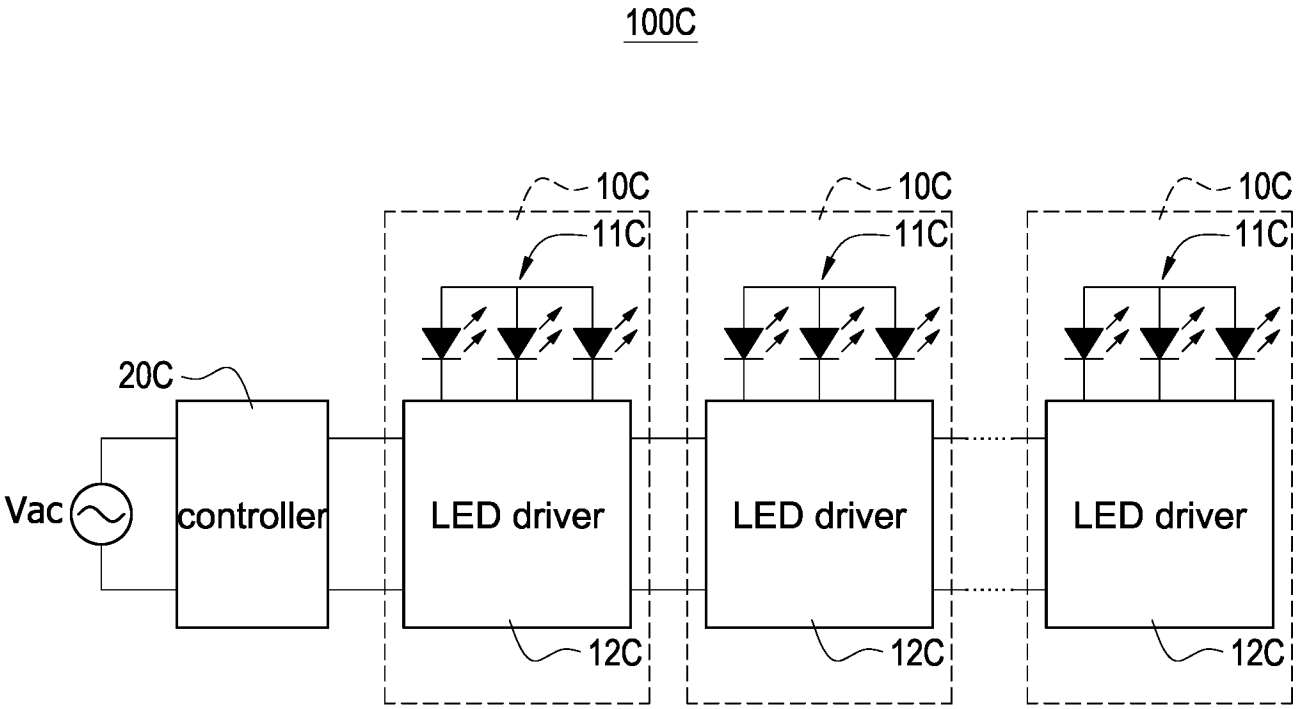
FIG. 8 shows a block diagram of an LED light string according to the present disclosure.

FIG. 8 shows a block diagram of an LED light string according to the present disclosure. The LED light string 100C is a two-wire structure, and the LED light string 100C includes a plurality of LED modules 10C and a controller 20C. The LED modules 10C are electrically connected to each other. The controller 20C includes a power conversion circuit (not shown) and a control circuit (not shown), i.e., the power conversion circuit and the control circuit may be integrated into the controller 20C. Specifically, the controller 20C may be implemented by a physical circuit control box including the power conversion circuit and the control circuit. The power conversion circuit receives an AC power source Vac and converts the AC power source Vac into a DC power source. The control circuit receives the DC power source to supply the required DC power for the control circuit and the LED light string 100C.

Each of the LED modules 10C includes at least one LED 11C and a LED driver with burning function 12C (hereinafter referred to as LED driver 12C). Each LED module 10C shown in FIG. 8 has three LEDs 11C involving three primary colors of red (R), green (G), and blue (B). The LED driver 12C is coupled to the at least one LED 11C and the LED driver 12C burns an ordinal number according to connection sequence thereof. In one embodiment, each of the LED modules 10C is a LED module having data burning function, and therefore each of the LED modules 10C has own digital and analog circuits for burning light data and sequence (ordinal number) data.

The control circuit of the controller 20C can receive external light control data through a wired manner or a wireless manner as well as read internal light data stored inside the control circuit so that the control circuit can control each of the LED modules 10C of the LED light string 100C according to the content of the light control data. For example, the user may operate a computer through the wired manner to transmit the light control data to the control circuit so that the control circuit controls the LED modules 10C according to the light control data. Alternatively, the user may operate a mobile phone or a wearable device through the wireless manner to transmit the light control data to the control circuit so that the control circuit controls the LED modules 10C according to the light control data. However, the present disclosure is not limited by the above-mentioned manners of transmitting the light control data and the devices operated by the user.

Figure 9A:
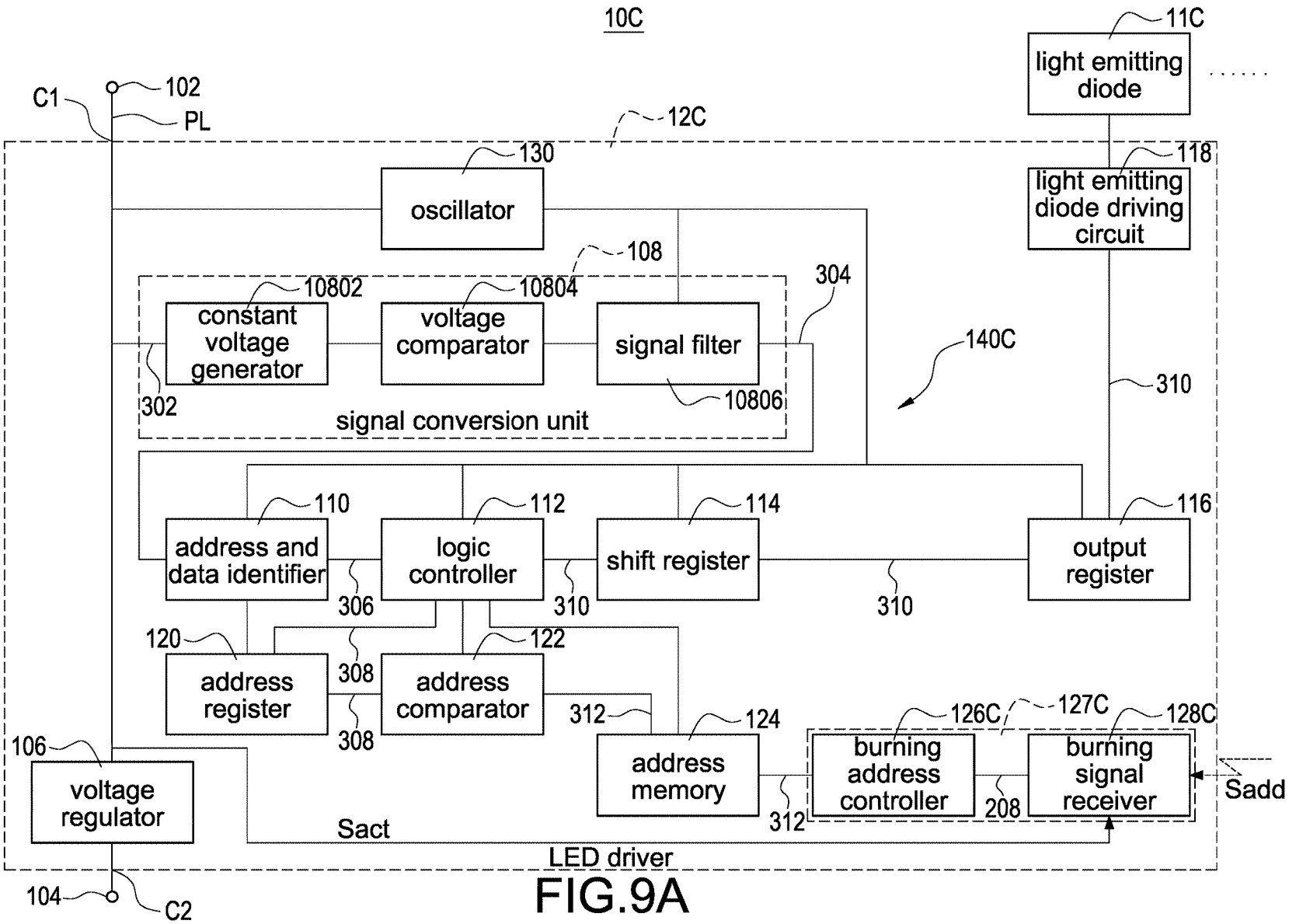
FIG. 9A shows a block diagram of a first embodiment of using a burning signal according to the present disclosure.

FIG. 9A shows a block diagram of a first embodiment of using a burning signal according to the present disclosure. The LED lamp 10C (i.e., the LED module 10C) includes at least one LED 11C and an LED driver 12C. The LED driver 12C includes at least two terminals C1,C2/C1,C2,C3 (detailed as follows), a burning processor 127C, and an address memory 124. In this embodiment, a first terminal C1 (i.e., a power input terminal) and a second terminal C2 (i.e., a power output terminal) are externally coupled to a power line PL. The LED driver 12C receives the required power through the power line PL.

The burning processor 127C receives a burning activation data Sact of a burning signal through the first terminal C1 or the second terminal C2 from the power line PL, and directly and externally receives a burning address data Sadd of the burning signal without from the power line PL. When a burning function of the burning processor 127C is activated by the burning activation data Sact, the burning processor 127C converts the burning address data Sadd into a local address data 312 and burns the local address data 312 into the address memory 124 so that the LED lamp 10C operates in a burning mode. After the local address data 312 are completely burned into the address memory 124, the LED lamp 10C operates in a lighting mode from the burning mode.

In one embodiment, the burning processor 127C includes a burning signal receiver 128C and a burning address controller 126C. As shown in FIG. 9A, the burning signal receiver 128C receives the burning activation data Sact and the burning address data Sadd. The burning address controller 126C is coupled to the burning signal receiver 128C and the address memory 124. When the burning address controller 126C receives the burning activation data Sact to activate the burning function, the burning address controller 126C receives the burning address data Sadd, converts the burning address data Sadd into the local address data 312, and burns the local address data 312 into the address memory 124.

The LED driver 12C further includes a lighting processor 140C. The lighting processor 140C is responsible for lighting control, lighting processing, and so forth. The lighting processor 140C is externally connected to the power PL, and receives a lighting signal with an address data and a lighting data through the power line PL. When the burning function of the burning processor 127C is activated, the lighting processor 140C is disabled. On the contrary, after the local address data 312 are completely burned into the address memory 124, the burning processor 127C is disabled and the lighting processor 140C drivers the at least one LED 11C to work in the lighting mode according to the lighting signal.

In particular, when the burning signal receiver 128C determines that a voltage of the burning address data Sadd is greater than a first predetermined threshold voltage, the burning address controller 126C receives the burning address data Sadd. In addition, when the burning signal receiver 128C determines that a voltage of the burning activation data Sact is greater than a second predetermined threshold voltage, the burning address controller 126C activates the burning function.

In this embodiment shown in FIG. 9A, the burning processor 127C receives the burning activation data Sact in a contact manner from the power line PL, and receives the burning address data Sadd in a contactless manner, that is, the burning activation data Sat is a carrier-wave data, and the burning address data Sadd may be, for example but not limited to, a radio-wave data or a light-wave data.

Figure 9B:
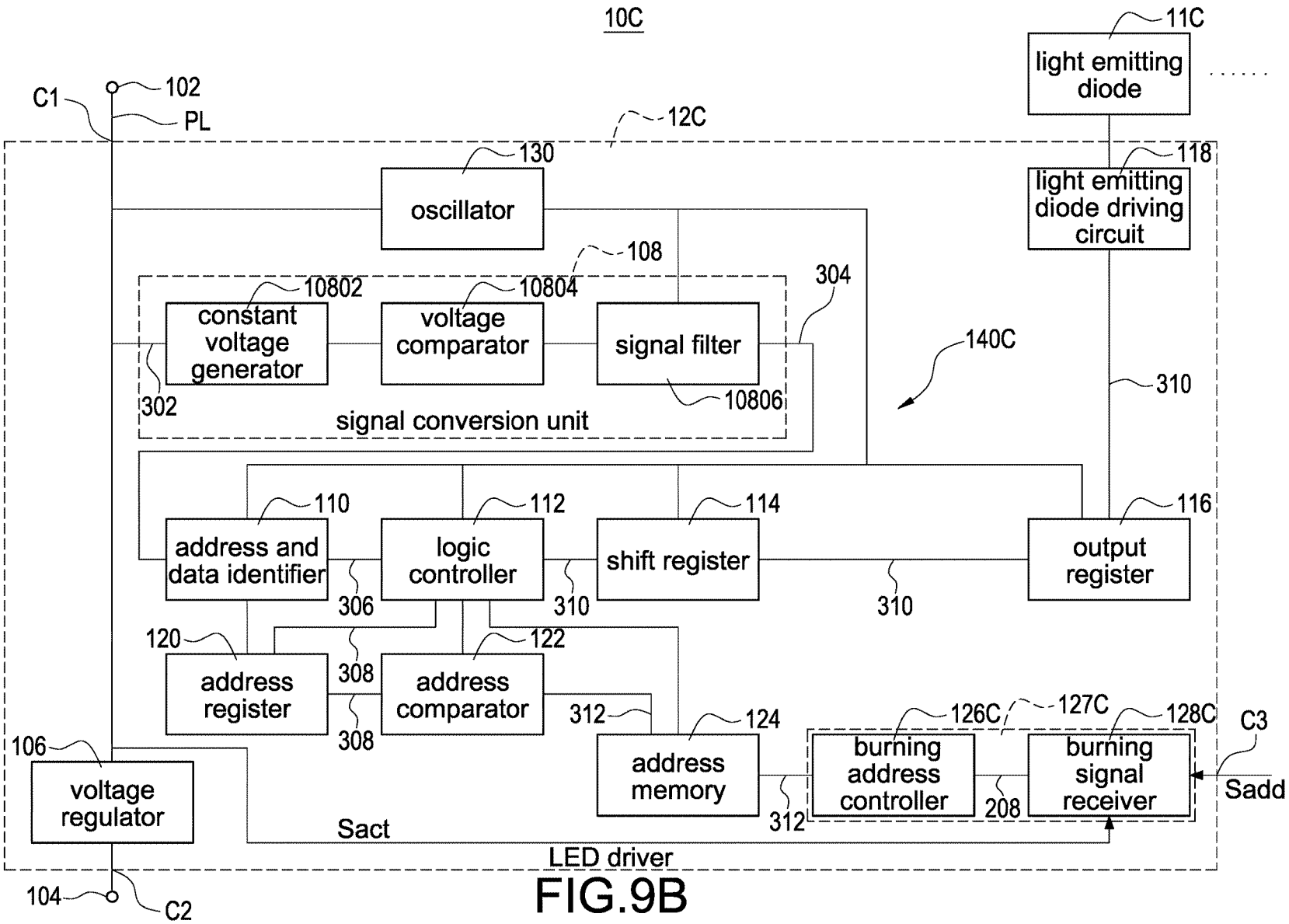
FIG. 9B shows a block diagram of a second embodiment of using the burning signal according to the present disclosure.

FIG. 9B shows a block diagram of a second embodiment of using the burning signal according to the present disclosure. The major difference between FIG. 9B and FIG. 9A is that the LED driver 12C of the former has three terminals, in addition to the first terminal C1 and the second terminal C2 coupled to the power line PL, further including a third terminal C3. In this embodiment of FIG. 9B, the third terminal C3 is provided for the burning signal receiver 128C of the burning processor 127C directly and externally receiving the burning address data Sadd.

Figure 10A:
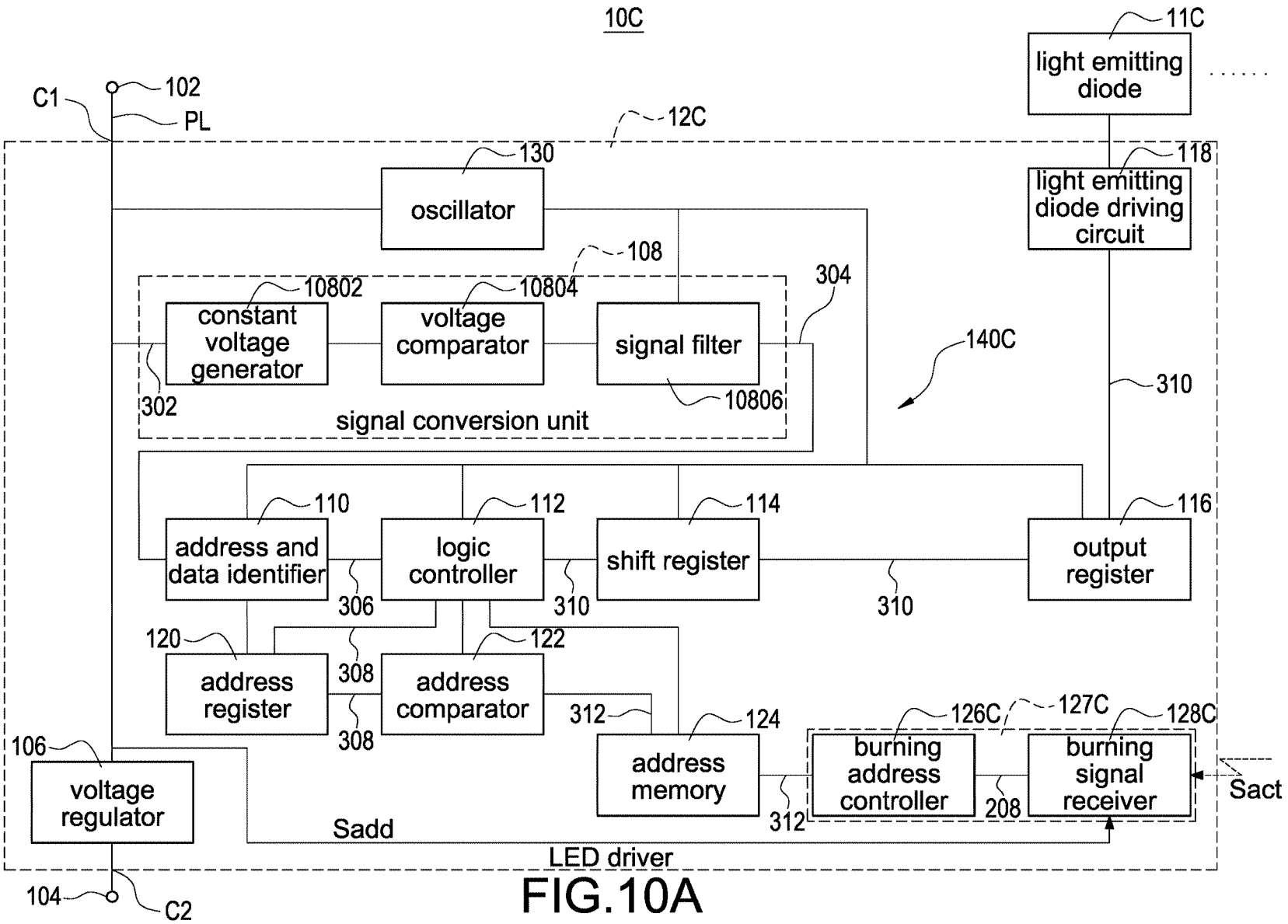
FIG. 10A shows a block diagram of a third embodiment of using the burning signal according to the present disclosure.

FIG. 10A shows a block diagram of a third embodiment of using the burning signal according to the present disclosure. The major difference from FIG. 9A, in FIG. 10A, the burning signal receiver 128C of the burning processor 127C receives the burning address data Sadd from the power line PL, and directly and externally receives the burning activation data Sact without from the power line PL. Specifically, the burning signal receiver 128C receives the burning activation data Sact in a contactless manner, that is, the burning address data Sadd is a carrier-wave data, and the burning activation data Sact may be, for example but not limited to, a radio-wave data or a light-wave data.

Figure 10B:
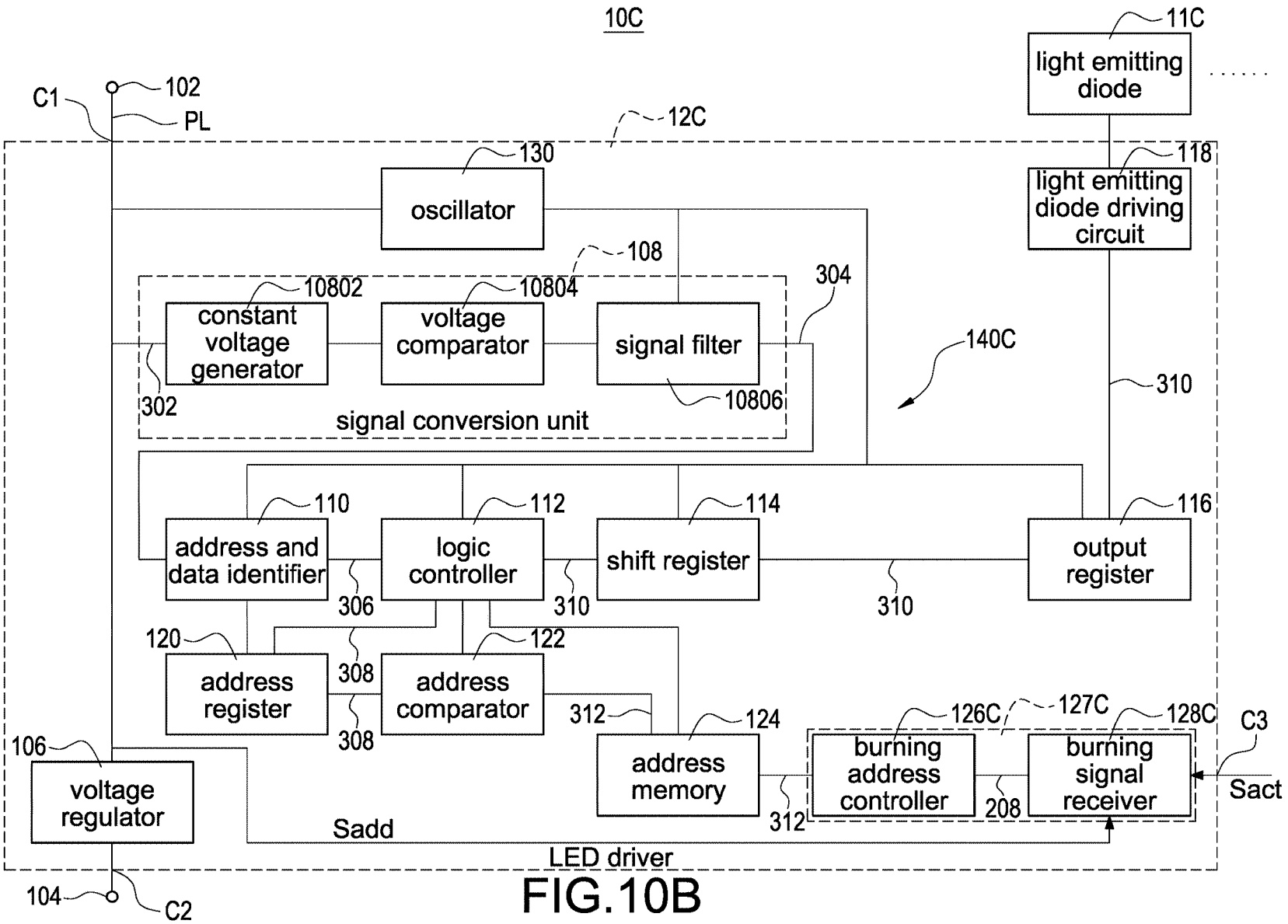
FIG. 10B shows a block diagram of a fourth embodiment of using the burning signal according to the present disclosure.

FIG. 10B shows a block diagram of a fourth embodiment of using the burning signal according to the present disclosure. The major difference between FIG. 10B and FIG. 10A is that the LED driver 12C of the former has three terminals, in addition to the first terminal C1 and the second terminal C2 coupled to the power line PL, further including a third terminal C3. In this embodiment of FIG. 10B, the third terminal C3 is provided for the burning signal receiver 128C of the burning processor 127C directly and externally receiving the burning activation data Sact.

Figure 11A:
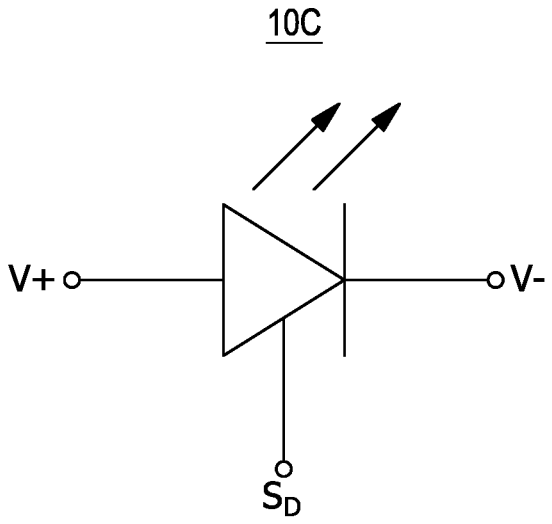
FIG. 11A shows a schematic view of a three-wire LED lamp according to the present disclosure.

FIG. 11A shows a schematic view of a three-wire LED lamp according to the present disclosure. As shown in FIG. 11A, the three-wire LED lamp 10C has three ends, including a positive power end V+, a negative power end V−, and a data signal end SD. In particular, the data signal end SD may be the third terminal C3 shown in FIG. 9B and FIG. 10B, and the positive power end V+ and the negative power end V− may be respectively the first terminal C1 and the second terminal C2 shown in FIG. 9A through FIG. 10B.

Figure 11B:
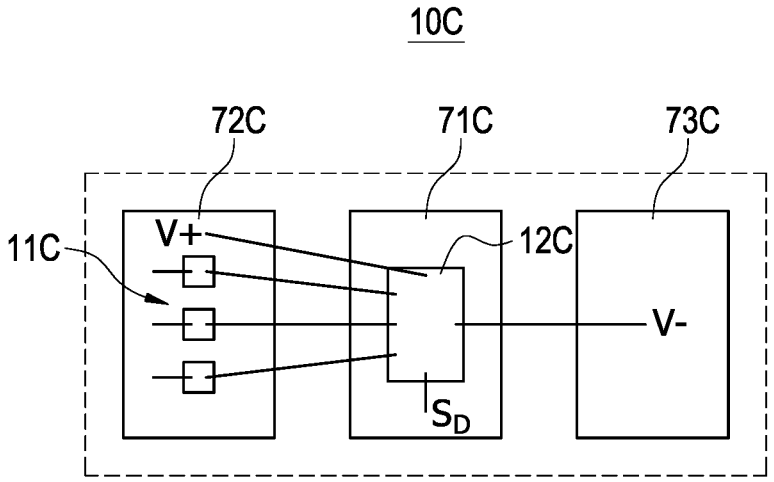
FIG. 11B shows a schematic top view of a package structure of the three-wire LED lamp according to the present disclosure.

Please refer to FIG. 11B, which shows a schematic top view of a package structure of the three-wire LED lamp according to the present disclosure. The LED driver 12C is disposed/mounted on a first plate 71C, such as but not limited to a welding plate, and the three LEDs 11C are disposed/mounted on a second plate 72C (not labeled). The three LEDs 11C are electrically connected to the LED driver 12C by a wire bonding manner. In this embodiment, the data signal end SD is provided from the first plate 71C, the positive power end V+ is provided from the second plate 72C, and the negative power end V− is provided from a third plate 73C, thereby forming the LED lamp 10C with the three-wire structure. However, the positions of the positive power end V+, the negative power end V−, and the data signal end SD are not limited as shown in FIG. 11B, that is, the positive power end V+ may be provided from the third plate 73C and the negative power end V− may be provided from the second plate 72C.

Figure 12A:
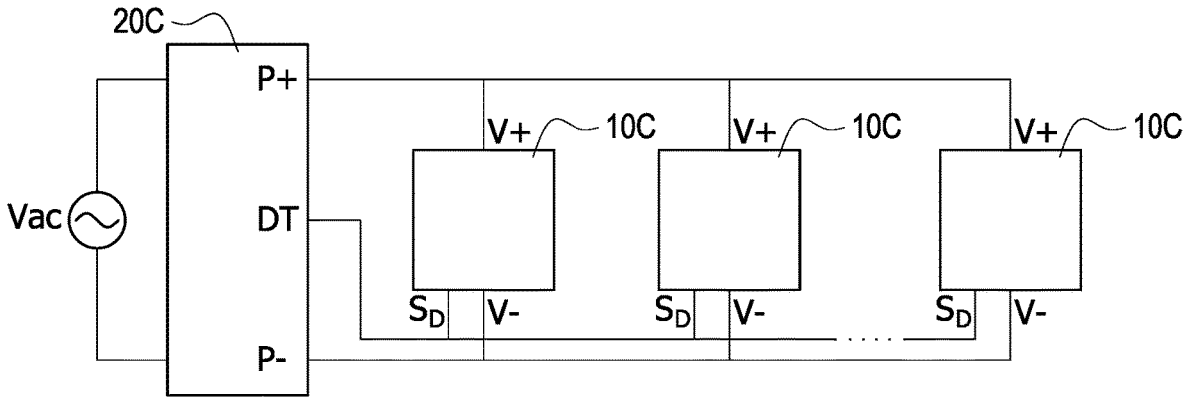
FIG. 12A shows a block circuit diagram of a plurality of three-wire LED lamps coupled in parallel according to the present disclosure.

Please refer to FIG. 12A, which shows a block circuit diagram of a plurality of three-wire LED lamps coupled in parallel according to the present disclosure. As mentioned above, the controller 20C receives the AC power source Vac and converts the AC power source Vac into the DC power source. The positive output of the DC power source is provided from a positive power end P+ of the controller 20C and the negative output of the DC power source is provided from a negative power end P− of the controller 20C. Further, the controller 20C provides/transmits a plurality of light mode data from a data end DT. In the parallel-connected structure, these positive power ends V+ of the plurality of LED lamps 10C are coupled to the positive power end P+ of the controller 20C, these negative power ends V− of the plurality of LED lamps 10C are coupled to the negative power end P− of the controller 20C, and these data signal ends SD of the plurality of LED lamps 10C are coupled to the data end DT of the controller 20C and receive the plurality of light mode data provided from the controller 20C through the data end DT.

Figure 12B:
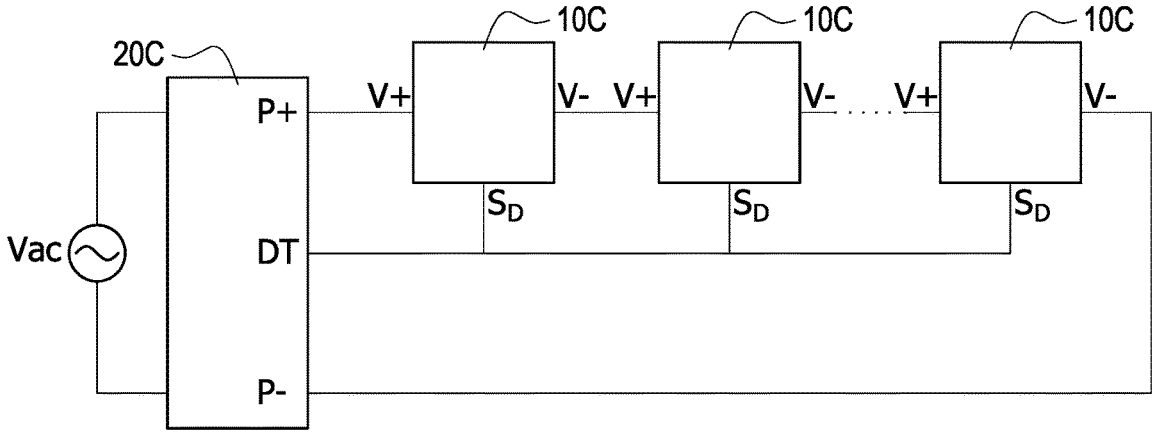
FIG. 12B shows a block circuit diagram of a plurality of three-wire LED lamps coupled in series according to the present disclosure.

Please refer to FIG. 12B, which shows a block circuit diagram of a plurality of three-wire LED lamps coupled in series according to the present disclosure. In the series-connected structure, these data signal ends SD of the plurality of LED lamps 10C are coupled to the data end DT of the controller 20C and receive the plurality of light mode data provided from the controller 20C through the data end DT. The positive power end V+ of the first LED lamp 10C is coupled to the positive power end P+ of the controller 20C, the negative end V− of the last LED lamp 10C is coupled to the negative power end P− of the controller 20C, and the remaining LED lamps 10C are coupled in series by connecting the positive power end V+ of the latter to the negative power end V− of the former.

Although the present disclosure has been described with reference to the preferred embodiment thereof, it will be understood that the present disclosure is not limited to the details thereof. Various substitutions and modifications have been suggested in the foregoing description, and others will occur to those of ordinary skill in the art. Therefore, all such substitutions and modifications are intended to be embraced within the scope of the present disclosure as defined in the appended claims.

What is claimed is:

1. A light emitting diode (LED) lamp comprising:

at least one LED, an LED driver comprising:

at least two terminals, having a power input terminal and a power output terminal, wherein the power input terminal and the power output terminal are externally coupled to a power line, a burning processor, configured to receive a burning activation data of a burning signal through the power input terminal or the power output terminal from the power line, and directly and externally receive a burning address data of the burning signal without the power line, and an address memory, and a lighting processor, externally connected to the power line, and configured to receive a lighting signal with an address data and a lighting data through the power line, wherein when a burning function of the burning processor is activated by the burning activation data, the burning processor converts the burning address data into a local address data and burns the local address data into the address memory so that the LED lamp operates in a burning mode according to the received and converted burning address data, wherein after the local address data are completely burned into the address memory, the LED lamp operates in a lighting mode according to the lighting signal from the burning mode.

2. The LED lamp as claimed in claim 1, wherein the burning processor comprises:

a burning signal receiver, configured to receive the burning activation data and the burning address data, and a burning address controller, coupled to the burning signal receiver and the address memory, wherein when the burning address controller receives the burning activation data to activate the burning function, the burning address controller receives the burning address data, converts the burning address data into the local address data, and burns the local address data into the address memory.

3. The LED lamp as claimed in claim 2, wherein when the burning signal receiver determines that a voltage of the burning address data is greater than a first predetermined threshold voltage, the burning address controller receives the burning address data.

4. The LED lamp as claimed in claim 2, wherein when the burning signal receiver determines that a voltage of the burning activation data is greater than a second predetermined threshold voltage, the burning address controller activates the burning function.

5. The LED lamp as claimed in claim 1, wherein the number of the at least two terminals of the LED driver is two; the burning processor receives the burning activation data in a contact manner, and receives the burning address data in a contactless manner.

6. The LED lamp as claimed in claim 5, wherein the burning address data is a radio-wave data or a light-wave data.

7. The LED lamp as claimed in claim 1, wherein the number of the at least two terminals of the LED driver is three; the burning processor receives the burning activation data in a contact manner, and receives the burning address data in a contact manner.

8. The LED lamp as claimed in claim 7, wherein the LED driver has a third terminal; the burning processor directly and externally receives the burning address data through the third terminal.

9. The LED lamp as claimed in claim 1, wherein the burning activation data is a carrier-wave data.

10. The LED lamp as claimed in claim 1, wherein when the burning function of the burning processor is activated, the lighting processor is disabled; after the local address data are completely burned into the address memory, the burning processor is disabled and the lighting processor drives the at least one LED to work in the lighting mode according to the lighting signal.

11. A light emitting diode (LED) lamp comprising:

at least one LED, an LED driver comprising:

at least two terminals, having a power input terminal and a power output terminal, wherein the power input terminal and the power output terminal are externally coupled to a power line, a burning processor, configured to receive a burning address data of a burning signal through the power input terminal or the power output terminal from the power line, and directly and externally receive a burning activation data of the burning signal without the power line, and an address memory, and a lighting processor, externally connected to the power line, and configured to receive a lighting signal with an address data and a lighting data through the power line, wherein when a burning function of the burning processor is activated by the burning activation data, the burning processor converts the burning address data into a local address data and burns the local address data into the address memory so that the LED lamp operates in a burning mode according to the received and converted burning address data, wherein after the local address data are completely burned into the address memory, the LED lamp operates in a lighting mode according to the lighting signal from the burning mode.

12. The LED lamp as claimed in claim 11, wherein the burning processor comprises:

a burning signal receiver, configured to receive the burning activation data and the burning address data, and a burning address controller, coupled to the burning signal receiver and the address memory, wherein when the burning address controller receives the burning activation data to activate the burning function, the burning address controller receives the burning address data, converts the burning address data into the local address data, and burns the local address data into the address memory.

13. The LED lamp as claimed in claim 12, wherein when the burning signal receiver determines that a voltage of the burning address data is greater than a first predetermined threshold voltage, the burning address controller receives the burning address data.

14. The LED lamp as claimed in claim 12, wherein when the burning signal receiver determines that a voltage of the burning activation data is greater than a second predetermined threshold voltage, the burning address controller activates the burning function.

15. The LED lamp as claimed in claim 11, wherein the number of the at least two terminals of the LED driver is two; the burning processor receives the burning address data in a contact manner, and receives the burning activation data in a contactless manner.

16. The LED lamp as claimed in claim 15, wherein the burning activation data is a radio-wave data or a light-wave data.

17. The LED lamp as claimed in claim 11, wherein the number of the at least two terminals of the LED driver is three; the burning processor receives the burning address data in a contact manner, and receives the burning activation data in a contact manner.

18. The LED lamp as claimed in claim 17, wherein the LED driver has a third terminal; the burning processor directly and externally receives the burning activation data through the third terminal.

19. The LED lamp as claimed in claim 11, wherein the burning address data is a carrier-wave data.

20. The LED lamp as claimed in claim 11, wherein when the burning function of the burning processor is activated, the lighting processor is disabled; after the local address data are completely burned into the address memory, the burning processor is disabled and the lighting processor drives the at least one LED to work in the lighting mode according to the lighting signal.

* * * * *